US008801164B2

(12) United States Patent
Hays et al.

(10) Patent No.: US 8,801,164 B2
(45) Date of Patent: Aug. 12, 2014

(54) ACTUATOR DEPRIME FOR BUBBLE CONTROL FOR INK JET PRINTHEAD

(75) Inventors: Andrew W Hays, Fairport, NY (US); Antonio L Williams, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 41 days.

(21) Appl. No.: 13/314,520

(22) Filed: Dec. 8, 2011

(65) Prior Publication Data

US 2013/0147879 A1 Jun. 13, 2013

(51) Int. Cl.
*B41J 2/19* (2006.01)
*B41J 2/175* (2006.01)

(52) U.S. Cl.
USPC ..... 347/92; 347/85

(58) Field of Classification Search
CPC ..... B41J 2/175; B41J 2/19; B41J 2/17; B41J 2/1707
USPC ..... 347/85, 92, 104
See application file for complete search history.

(56) References Cited

U.S. PATENT DOCUMENTS

| | | | | |
|---|---|---|---|---|
| 4,658,274 | A * | 4/1987 | DeYoung | 347/88 |
| 5,565,899 | A * | 10/1996 | Sugimoto et al. | 347/30 |
| 5,650,812 | A * | 7/1997 | Ochi et al. | 347/92 |
| 6,398,337 | B1 | 6/2002 | Wyble et al. | |
| 6,454,835 | B1 * | 9/2002 | Baumer | 95/19 |
| 6,517,189 | B2 * | 2/2003 | Ogawa et al. | 347/35 |
| 7,118,189 | B2 | 10/2006 | Kuester et al. | |
| 7,506,959 | B2 * | 3/2009 | Ueda et al. | 347/29 |
| 7,524,016 | B2 | 4/2009 | Silverbrook et al. | |
| 7,556,365 | B2 * | 7/2009 | Stathem | 347/86 |
| 7,604,337 | B2 * | 10/2009 | Koseki | 347/92 |
| 7,661,083 | B2 | 2/2010 | Zarkesh-Ha et al. | |
| 7,828,425 | B2 * | 11/2010 | Kang et al. | 347/93 |
| 7,918,530 | B2 | 4/2011 | Kanfoush et al. | |
| 8,506,061 | B2 * | 8/2013 | Park | 347/85 |
| 2003/0227520 | A1 * | 12/2003 | Yamanaka et al. | 347/85 |
| 2005/0068394 | A1 * | 3/2005 | Inoue et al. | 347/93 |
| 2006/0279604 | A1 * | 12/2006 | Ueda et al. | 347/36 |
| 2009/0066747 | A1 | 3/2009 | Hays et al. | |
| 2009/0290002 | A1 * | 11/2009 | Katoh | 347/85 |
| 2010/0238227 | A1 | 9/2010 | Nystrom et al. | |
| 2011/0012945 | A1 * | 1/2011 | Coffey et al. | 347/7 |
| 2011/0012946 | A1 * | 1/2011 | Coffey et al. | 347/7 |
| 2011/0279607 | A1 * | 11/2011 | Yamamoto et al. | 347/93 |
| 2012/0050357 | A1 * | 3/2012 | Rasmussen | 347/6 |

* cited by examiner

*Primary Examiner* — Matthew Luu
*Assistant Examiner* — Patrick King
(74) *Attorney, Agent, or Firm* — MH2 Technology Law Group LLP

(57) ABSTRACT

A method and structure for depriming an ink jet printhead. To deprime ink from a printhead at a location between a nozzle (aperture) and a particulate filter (rock screen), a force (pressure) is applied to the ink. The pressure can either be a positive pressure applied to the nozzle from the outside of the aperture plate or a negative pressure (vacuum) applied at a location upstream from the particulate filter. Because openings within the particulate filter are each smaller than the nozzle, there exists a force which is sufficient to move a meniscus of the ink from the nozzle back to the particulate filter, but which is insufficient to move the meniscus beyond the particulate filter, for example due to a surface tension of the meniscus of the ink.

7 Claims, 6 Drawing Sheets

ACTUATOR DEPRIME FOR BUBBLE CONTROL FOR INK JET PRINTHEAD

FIELD OF THE EMBODIMENTS

The present teachings relate to the field of printing, and more particularly to printhead structures and methods for ink jet printing.

BACKGROUND OF THE EMBODIMENTS

Ink jet printers typically use either thermal ink jet technology or piezoelectric technology. Even though they are more expensive to manufacture than thermal ink jets, piezoelectric ink jets are generally favored as they can use a wider variety of inks and eliminate problems with kogation.

Piezoelectric ink jet printheads typically include a flexible diaphragm manufactured from stainless steel. Piezoelectric ink jet printheads can also include an array of piezoelectric transducers (i.e., actuators) attached to the diaphragm. Other printhead structures can include one or more laser-patterned dielectric standoff layers and a flexible printed circuit (flex circuit) or printed circuit board (PCB) electrically coupled with each transducer. A printhead can further include a body plate, an outlet plate, and an aperture plate, each of which can be manufactured from stainless steel. The aperture plate includes a plurality of nozzles (i.e., one or more openings, apertures, or jets) through which ink is dispensed during printing. The number of nozzles per unit area generally determines the printer resolution, with higher resolution devices having more apertures within a given area. As printer resolution increases, the size of the nozzles and the quantity of ink in each ink drop dispensed onto a print medium decreases.

During use of a piezoelectric printhead, a voltage is applied to a piezoelectric transducer, typically through electrical connection with a flex circuit electrode electrically coupled to a voltage source, which causes the piezoelectric transducer to bend or deflect, resulting in a flexing of the diaphragm. Diaphragm flexing by the piezoelectric transducer provides a pressure pulse to the ink within an ink chamber within the printhead to expel a quantity of ink from a chamber through a particular nozzle in the aperture plate. When the voltage is removed and the diaphragm returns to its relaxed (unflexed) position, it draws ink into the chamber from a main ink reservoir through an opening to replace the expelled ink.

During printhead manufacture, contaminants can be introduced into the printhead. These contaminants can be transported to the nozzle during printing where they can block the flow of ink through the nozzle thereby reducing print quality. To filter contaminants in the printhead, a stainless steel particulate filter or "rock screen" can be used.

Printhead structures and methods which improve print quality and reduce ink use would be desirable.

SUMMARY OF THE EMBODIMENTS

The following presents a simplified summary in order to provide a basic understanding of some aspects of one or more embodiments of the present teachings. This summary is not an extensive overview, nor is it intended to identify key or critical elements of the present teachings nor to delineate the scope of the disclosure. Rather, its primary purpose is merely to present one or more concepts in simplified form as a prelude to the detailed description presented later.

An embodiment of the present teachings can include a method for depriming a printhead, including providing a printhead, the printhead having an aperture plate with at least one nozzle therein and an ink port having an ink port first chamber and an ink port second chamber, wherein the ink port first chamber is separated from the ink port second chamber by a particulate filter. The method can further include filling the ink port first chamber and the ink port second chamber with ink and applying a deprime pressure to the ink within the ink port, wherein the deprime pressure is sufficient to move a meniscus of the ink from the nozzle to the particulate filter, but is insufficient to move the meniscus of the ink past the particulate filter.

Another embodiment of the present teachings can include a method for printing onto a print medium using a printer having a printhead, the method including depriming the printhead by applying a deprime pressure to ink within the printhead of the printer, wherein the deprime pressure is sufficient to move a meniscus of the ink from a nozzle of the printhead to a particulate filter of the printhead, but is insufficient to move the meniscus of the ink past the particulate filter, priming the printhead, and printing the deprimed ink onto the print medium using the printer.

Another embodiment of the present teachings can include a printer having a particulate filter with a plurality of openings therethrough, a printhead having an ink port, wherein the ink port is divided into a first ink port chamber and a second ink port chamber by the particulate filter, a pump configured to impart a deprime pressure to ink within the ink port, wherein the deprime pressure is sufficient to deprime the printhead by moving a meniscus of the ink from a nozzle to the particulate filter but is insufficient to move the meniscus of the ink past the particulate filter.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

Figure 1:
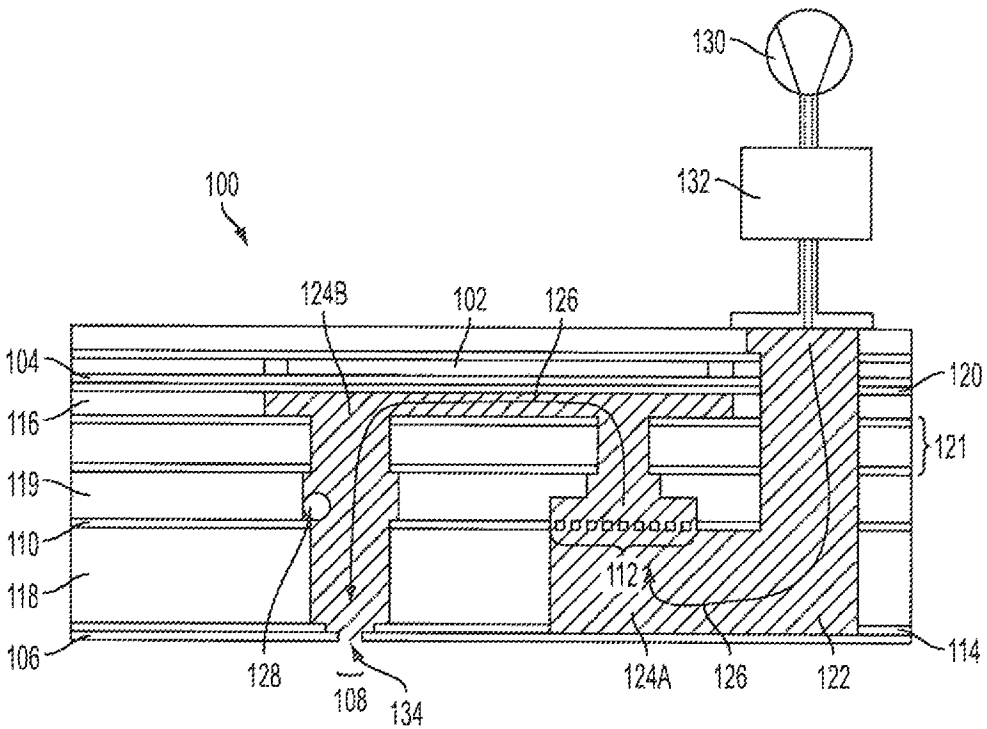
FIG. 1 is a cross section depicting a structure according to an embodiment of the present teachings including an ink port which is part of an ink jet printhead, ink which fills the ink port, and a pump which can be used to deprime the printhead ink port.

It should be noted that some details of the FIGS. have been simplified and are drawn to facilitate understanding of the present teachings rather than to maintain strict structural accuracy, detail, and scale.

DESCRIPTION OF THE EMBODIMENTS

Reference will now be made in detail to the exemplary embodiments of the present teachings, an example of which is illustrated in the accompanying drawings. Wherever possible, the same reference numbers will be used throughout the drawings to refer to the same or like parts.

As used herein unless otherwise specified, the word "printer" encompasses any apparatus that performs a print outputting function for any purpose, such as a digital copier, a bookmaking machine, a facsimile machine, a multi-function machine, a plotter, etc. The word "polymer" encompasses any one of a broad range of carbon-based compounds formed from long-chain molecules including thermosets, thermoplastics, resins such as polycarbonates, epoxies, and related compounds known to the art. The terms "upstream" and "downstream" refer to the direction relative to the of the flow of ink through a printhead. The term "meniscus" refers to a leading edge of a fluid such as printer ink, or where the ink contacts a gas such as air.

In the manufacture of printers, costs can be reduced by substituting lower cost materials and print quality can be improved by using materials which are better suited for a particular function. For example, materials such as polymers are becoming increasingly common in printhead manufacture for their low cost, ease of manufacture, and improved functionality for some uses.

In addition to decreasing manufacturing costs, reducing energy use is a concern to printer manufacturers. Reduction of energy use decreases customer costs, can be a marketing advantage, and is necessary to meet various energy use standards such as Energy Star® requirements. A printer can be powered down during periods of low or no use either by a user or through an automatic idle printer function to decrease energy consumption.

Powering down a printer during periods of low use can result in a printhead which reaches ambient temperatures. In cold conditions, powering down the printer can result in freezing of the printhead and the ink. The volume of ink can decrease when it freezes, and frozen ink may therefore shrink during freezing and pull away from a wall of the actuator to expose an edge of a polymer layer to ambient air. In contrast to metal which polymers can replace for some uses, polymers have the property of absorbing moisture from ambient air which enters the printhead through the nozzle. Without intending to be bound by theory, it has been found that, over time, the ambient moisture can diffuse into the polymer layer. As the temperature of the printhead is elevated above freezing during a power up or increasing ambient temperatures, this moisture can outgas from the polymer layer to form bubbles within the ink. In addition, bubbles can form as the ink freezes and shrinks. Bubbles within the ink can absorb the pressure impulse imparted to the ink by the transducer during printing which may result in an insufficient quantity of ink being expelled from the nozzle during printing. In extreme circumstances the pressure pulse from the actuator can be entirely absorbed by air bubbles within the ink to the point where ink jetting ceases. Either condition is a failure mode which can result in unacceptable printer performance.

To clear the bubbles, a purge function can be performed which forces a quantity of ink and the bubbles out of the nozzles. However, this purging function requires a quantity of ink not subsequently used for printing, which is a process that is expensive to the consumer.

The present teachings provide a method and structure which can remove bubbles from ink within a printhead. In an embodiment, the method and structure performs this function without using ink. The method and structure can employ the use of the particular characteristics of the nozzle and particulate filter (rock screen) to remove these bubbles.

FIG. 1 depicts a cross section of a portion of a printhead 100 for an ink jet printer. It will be understood that FIG. 1 depicts one particular printhead design, and other designs can be different from those depicted in the FIGS. The FIG. 1 structure can include a piezoelectric actuator 102, a diaphragm 104, and an aperture plate 106 having a nozzle (opening or aperture) 108. FIG. 1 further depicts a rock screen layer 110 including a rock screen 112 having a plurality of filter openings therethrough. The FIG. 1 structure depicts various other layers such as an aperture plate adhesive 114, a body plate 116, an inlet/outlet plate or manifold 118, a separator 119, a diaphragm adhesive 120, a vertical inlet 121 which can include more than one individual layer between the body plate 116 and the separator 119 as depicted, as well as other layers.

During printing, ink 122 within an ink port 124 travels along an ink path 126. For purposes of description the ink port 124 can be divided into a first chamber 124A which is upstream of the particulate filter 112 and a second chamber 124B which is downstream of the particulate filter 112. A printhead priming operation can be performed to move the ink through the ink port first chamber 124A and into the ink port second chamber 124B. Once the printhead is primed, a voltage on the actuator 102 causes the actuator 102 to deflect toward the nozzle 108, thereby causing a pressure pulse which forces ink 122 from the nozzle 108. When the voltage is removed, the actuator 102 returns to a relaxed state and draws ink from an ink reservoir (not individually depicted for simplicity) at an upstream location into the ink port 124 to replace the expelled ink. FIG. 1 further depicts a bubble 128, for example ambient air, which can form as a result of a process as described above, or through some other mechanism.

The particulate filter 112 is located within the ink port 124, specifically within the ink path 126 of the ink port, to filter any particulates from the ink which might be of a sufficient size to block the nozzle 108. To filter particulates of a sufficient size, the openings within the rock screen 112 must be smaller than the size of the nozzle 108. In an embodiment, an average size of the plurality of the openings is less than the size of the nozzle 108, with no opening in the particulate filter being larger than the nozzle 108. In an exemplary embodiment using present technology, a diameter (in the case of a circular opening) or a width (in the case of a noncircular opening, such as a square, rectangular, or polygonal opening, for example) of the openings within the rock screen 112 can be about 15 μm, while a diameter (width) of the nozzle 108 can be about 39 μm. It will be understood that other sizes of filter openings and nozzles can be formed, but the openings within filter 112 will be smaller than the nozzle openings 108 within the aperture plate 106 to provide sufficient filtration of particulates from the ink 122.

While FIG. 1 depicts a single nozzle 108 within nozzle plate 106, the nozzle plate 106 can include hundreds or thousands of nozzles 108. For a color printer, each ink port and nozzle 108 is dedicated to a single color, and other ports and nozzles can be dedicated to dispensing other colors. In an embodiment, a printhead can have hundreds or thousands of ink ports. Further, a rock screen layer 110 can include hundreds or thousands of individual rock screens 112, with one rock screen 112 being located within a single ink port 124 and thereby associated with a single nozzle 108.

Because each opening through the rock screen 112 has a smaller diameter (width) than the nozzle 108, the force of capillarity (i.e., capillary action) exerted on the ink 122 by the rock screen 112 at a meniscus 134 of the ink is larger than the force of capillarity exerted on the ink 122 by the nozzle 108. In an embodiment, this difference in force which is required to move the meniscus 134 can be exploited during a process to deprime ink 122 from the ink port second chamber 124B, but not to force the ink past the rock screen 112. In other words, there exists a force which is sufficient to move the meniscus (i.e., the leading edge) of the ink from the nozzle 108 as depicted in FIG. 1 back to the rock screen 112, but which is insufficient to move the meniscus beyond the rock screen 112.

Surface tension of ink is about 28 dynes/cm and the contact angle for an interface of ink and polyimide is about 25°. A maximum pressure differential for a given size opening that is sustainable across the ink meniscus at the given opening can be determined using the formula:

$$P=\cos(e)*2\gamma/r$$

where "P" is the maximum pressure differential, "cos( )" is a multiplier including the cosine of the fluid (ink) contact angle, "γ" is surface tension of the meniscus of the fluid (ink), and "r" is the radius of the opening. For a nozzle diameter of 30 μm, the meniscus can be maintained at the aperture up to a pressure of about 0.46 psi such that a pressure differential greater than 0.46 psi will force the meniscus away from the nozzle 108. For a rock screen having a plurality of filter openings, wherein each opening is 15 μm, the meniscus can be maintained at the filter openings up to a pressure of about 0.91 psi such that a pressure greater than 0.91 psi will force the meniscus away from the rock screen. Therefore, by applying a constant pressure differential from somewhere between about 0.46 psi and about 0.91 psi, for example about 0.7 psi in this specific case, the meniscus can be moved from the nozzle 108 to the rock screen 112, and the meniscus will hold at the rock screen 112.

For a generalized equation for any nozzle shape, a different equation can be used to calculate the pressure differential so that a suitable deprime pressure can be determined. An embodiment can include an equation which uses the Young-Laplace equation, such as:

$$\Delta P = \cos(\theta) * \gamma\left(\frac{1}{R_x} + \frac{1}{R_y}\right)$$

where "ΔP" is the pressure difference across the fluid interface, " cos( )" is a multiplier including the cosine of the fluid contact angle, "γ" is the surface tension of the fluid meniscus, and $R_x$ and $R_y$ are the principle radii of curvature of the meniscus.

To determine the deprime pressure to apply to the ink, a first maximum pressure differential that is sustainable across the ink meniscus at the nozzle can be determined using the formula in the previous paragraph above, or a different formula. A second maximum pressure differential that is sustainable across the ink meniscus at the particulate filter can be determined using the formula in the previous paragraph above, or a different formula. After determining these two pressure differentials, a suitable deprime pressure can be selected as a value between the first maximum pressure differential and the second maximum pressure differential.

In an embodiment, ink 122 can be deprimed out of the ink port second chamber 124B using the deprime pressure. The ink 122 can be subsequently pumped back into the ink port second chamber 124B using, for example, conventional ink priming techniques in preparation for printing. In an embodiment, the printhead can be deprimed at a power down process and then the ink 122 is replaced back into the ink port second chamber 124B using a priming process in preparation for printing. Purging the ink at power down can draw ambient air into the ink port second chamber 124B. Any outgassing of moisture from a layer such as a polymer layer as described above will not form bubbles within the ink, as little if any ink remains in the ink port second chamber 124B subsequent to depriming. In addition, any bubbles of air, steam, etc., within the ink port second chamber 124B will not move past the rock screen 112, and can be returned to the atmosphere during a subsequent ink priming process.

Figure 2:
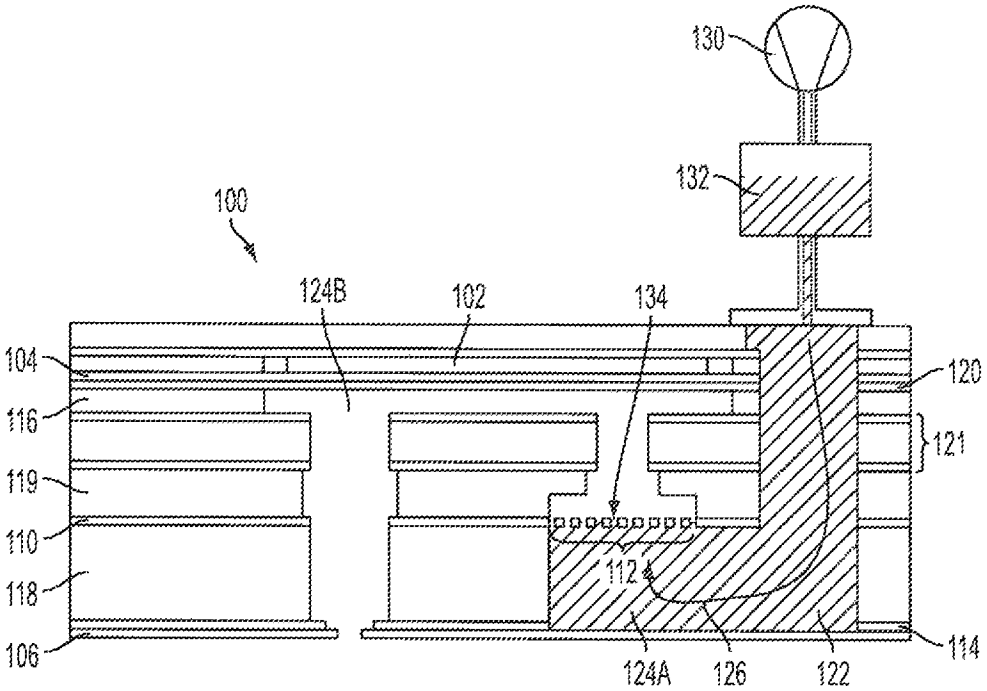
FIG. 2 is a cross section depicting the FIG. 1 structure after performing a deprime process.

In an embodiment, a pump 130 such as a peristaltic pump is placed upstream relative to the direction of the flow of ink from the rock screen 112 as depicted in FIG. 1. The pump 130 can exert or impart a vacuum (i.e., a negative pressure) to the ink 122 and therefore to the meniscus 134 of the ink 122. The pressure exerted by the pump 130 is selected to be sufficient to move the meniscus of the ink 122 away from the aperture 108, but is insufficient to move the meniscus of the ink 122 past the rock screen 112. In the exemplary embodiment described above, the pump 130 can exert a pressure of about 0.7 psi to the ink meniscus 134. The vacuum pressure imparted by the pump 130 draws ink 122 back through the rock screen 112 until the ink meniscus 134 is located at the rock screen 112 as depicted in FIG. 2. Because the deprime pressure exerted by the pump 130 on the ink 122 is insufficient to overcome the force of capillarity applied to the ink 122 by the filter openings, each of which is relatively smaller than the size of the nozzle 108, the ink meniscus 134 stops at the rock screen 112 as depicted in FIG. 2. An intermediate reservoir 132 can be interposed between the pump 130 and the ink port 124 or at another location such that ink is stored in the intermediate reservoir 132. The intermediate reservoir 132 can be a conventional ink chamber or another structure.

Figure 3:
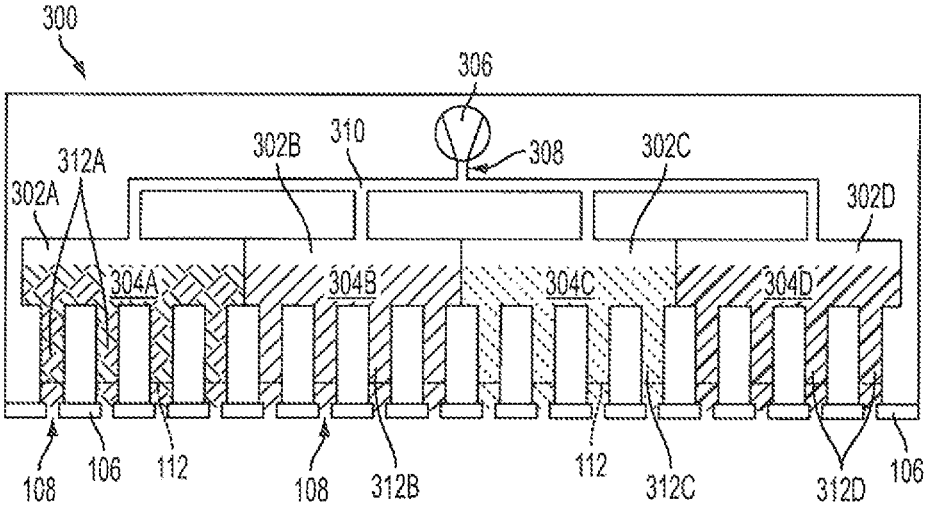
FIG. 3 is a cross section of an embodiment of the present teachings including a printhead having a plurality of ink ports which can output several colors, and a pump which can deprime the plurality of ink ports.

It will be understood that the embodiment of FIGS. 1 and 2 are schematic depictions, with pump 130 servicing a single ink port 124 and nozzle 108. FIG. 3 is a schematic depiction of an ink jet printhead 300 including four ink reservoirs 302A-302D, each of which includes a different color of ink 304A-304D. A pump 306 such as a peristaltic pump includes an output 308 which is connected through a channel 310 to each of the ink reservoirs 302A-302D. Each ink reservoir 302A-302D supplies ink 304 to a plurality of ink ports 312A-312D, with each ink port 312A-312D receiving ink from only one of the ink reservoirs 302A-302D as depicted. Each ink port 312A-312D includes a particulate filter 112 as described above, with each port 312 terminating in a separate nozzle 108. While FIG. 3 depicts four ports 312 for each ink color, each reservoir 302 can supply ink 304 to any number of ports. Further, while FIG. 3 depicts the four ports 312 for each color laterally adjacent to each other for simplicity, the ports 312 can be evenly distributed across the printhead for improved color blending.

During a deprime process, the pump 306 imparts a vacuum to the channel 310, and thus to the ink reservoirs 302A-302D. The vacuum pressure is sufficient to move the meniscus of the ink 304 which is within each of the ink ports 312A-312D from each aperture 108 to each rock screen 112, but is insufficient to move the meniscus past the rock screen 112. The deprime process can be performed during a printer power down sequence, for example which is initiated by the user or during a timed printer idle or standby mode. After the deprime process and prior to printing, the printer can be primed during a power up sequence in accordance with conventional techniques in preparation for printing.

Figure 4:
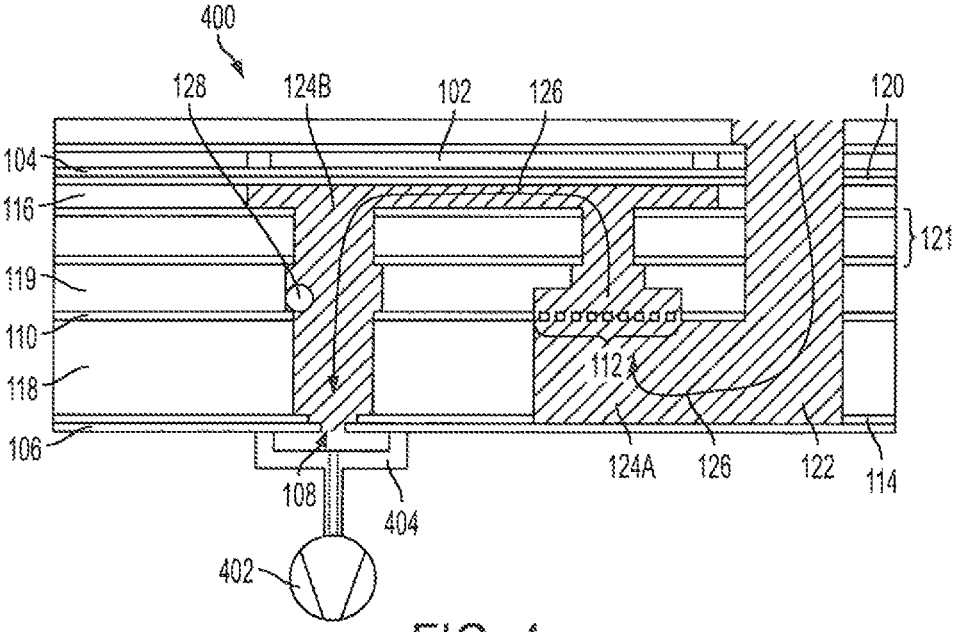
FIG. 4 is a cross section depicting structure according to another embodiment of the present teachings including an ink port which is part of an ink jet printhead, ink which fills the ink port, and a pump which can be used to deprime the printhead ink port.

FIG. 4 depicts a printhead 400 according to another embodiment of the present teachings. In this embodiment, a pump 402 such as a peristaltic pump is used to impart a positive pressure to the ink 122 from the nozzle 108. In this embodiment, an airtight cap 404 is placed in contact, for example airtight contact, with the aperture plate 106 and held in place during the application of a positive air pressure. The force of the positive pressure exerted on the ink 122 by the pump 402 from the nozzle 108 is selected such that it is sufficient to move the meniscus of the ink away from the nozzle 108 and toward the rock screen 112, but is insufficient to move the meniscus past the rock screen 112.

Figure 5:
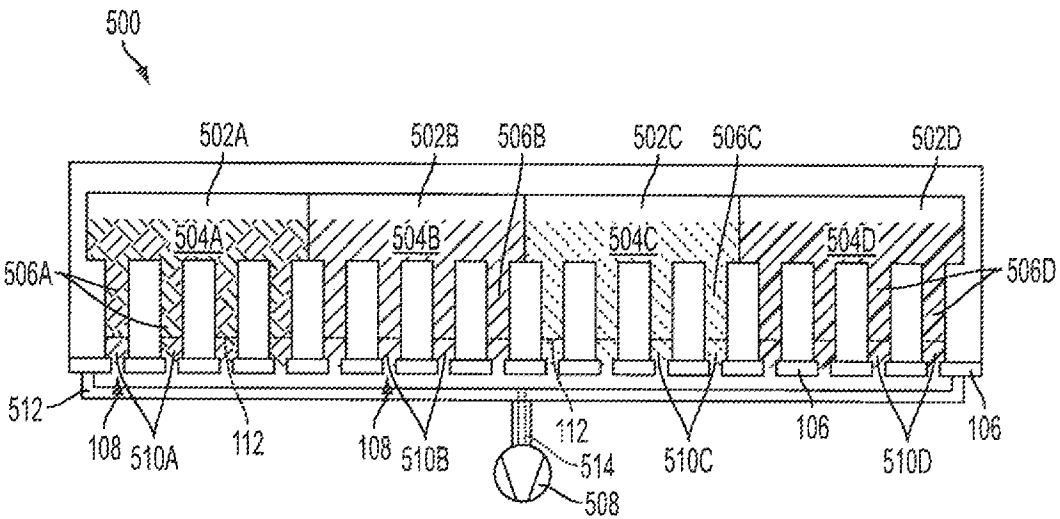
FIG. 5 is a cross section of another embodiment of the present teachings including a printhead having a plurality of ink ports which can output several colors, and a pump which can deprime the plurality of ink ports.

While the cap 404 of FIG. 4 covers a single aperture for description, it will be understood that a cap can cover an array of nozzles 108, for example all nozzles formed by the aperture plate 106. For example, the printhead 500 of FIG. 5 includes a plurality of ink reservoirs 502A-502D, each including a different color of ink 504A-504D. Each ink reservoir 502A-502D supplies a plurality of ink ports 506A-506D with ink 504. A pump 508 such as a peristaltic pump is used to impart a positive pressure to each ink port second chamber 510A-510D and to ink 504A-504D through each nozzle 108. In this embodiment, an airtight cap 512 is placed in contact with the aperture plate 106. The airtight cap 512 is held in place against the aperture plate 106 during the application of a positive air pressure to each nozzle 108 by the pump 508. The pump 508 is connected to the airtight cap 512 through a pump output 514 which transfers the air pressure output by the pump 508 to the airtight cap 512, and thus through the nozzle 108 to the ink 504A-504D. The force of the positive pressure exerted on the ink 504A-504D within each ink port first chamber 510A-510D by the pump 508 through each nozzle 108 is selected such that it is sufficient to move the meniscus of the ink away from the nozzle 108 and toward the rock screen 112, but is insufficient to move the meniscus past the rock screen 112.

Figure 6:
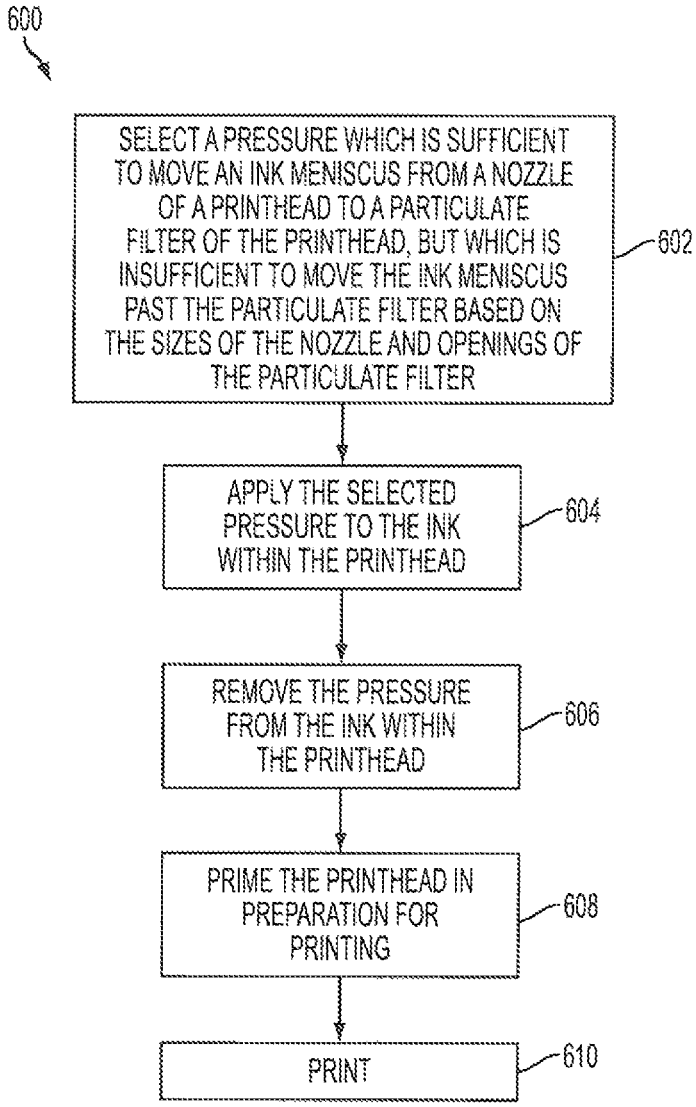
FIG. 6 is a flow chart of a process which can be used to deprime a printhead according to an embodiment of the present teachings.

FIG. 6 is a flow chart including method 600 for depriming a printhead of a printer, wherein the method includes various stages in accordance with an embodiment of the present teachings. It will be understood that not all process stages described in FIG. 6 are required, and that some processing stages can be removed or modified and additional stages can be added. At a first stage 602, a pressure is selected which is sufficient to move an ink meniscus from a printhead nozzle to a printhead particulate filter, but which is insufficient to move the ink meniscus past the particulate filter. The pressure selected will vary depending on the printhead materials, nozzle size, and particulate filter opening size, for example the diameter (width) of the nozzle and the diameter (width) of the particulate filter openings. Each opening within the particulate filter will be smaller than the nozzle (i.e., the aperture from which ink is dispersed onto a print medium such as paper during printing). As the difference in size between the nozzle and the particulate filter openings increases, the suitable pressure range will also increase. The pressure can be output by, for example, a pump such as a peristaltic pump. The actual pressure can be positive pressure or negative pressure (i.e., a vacuum). A pressure output by the pump may be larger than the suitable pressure if, for example, the pressure output by the pump is distributed between a plurality of ink ports.

Once the pressure is selected, the pressure is applied to the ink within the printhead 604. The pressure is applied for a duration of time sufficient to move the ink meniscus from the nozzle to the rock screen. After the application of pressure 604, the pressure is removed 606. Capillarity applied to the ink by the rock screen is sufficient to hold the ink meniscus at the rock screen such that the printer, if desired, can be powered down while maintaining deprime.

At some later time, the printhead can be powered up and prepared for printing 608. This can occur through conventional priming of the printhead, or through some other priming process. Once the printhead is prepared for printing 608, printing to a print medium can be performed 610.

Figure 7:
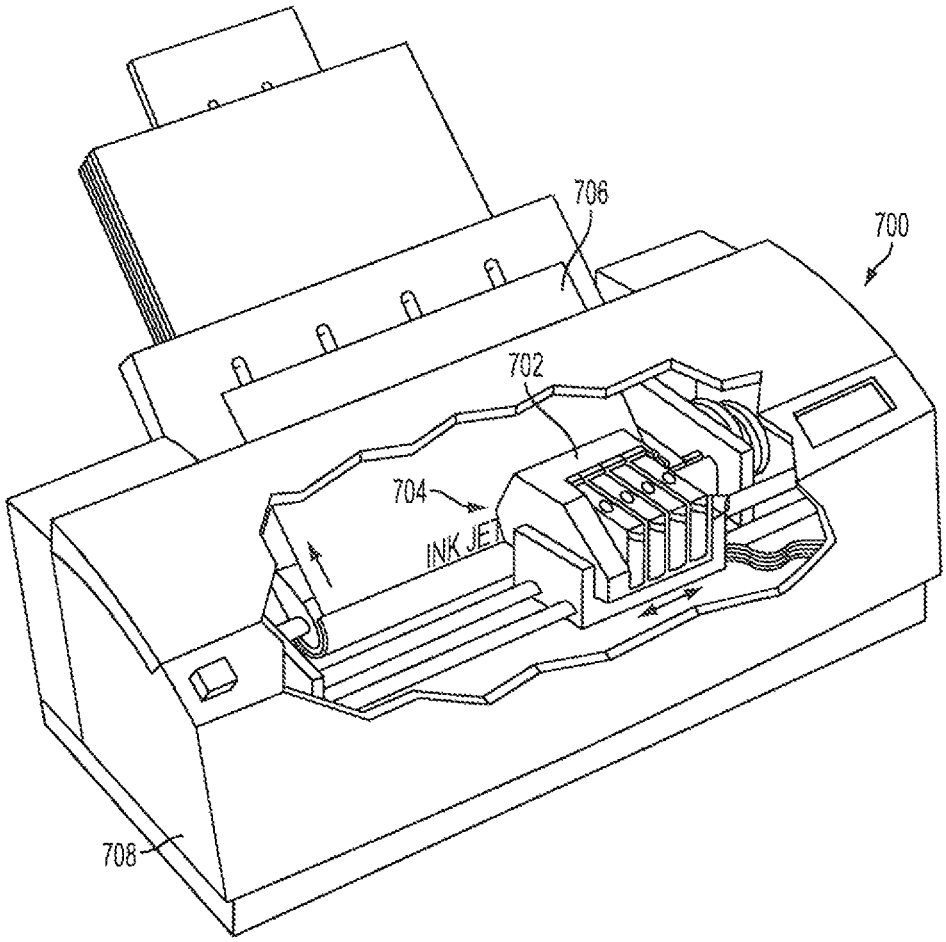
FIG. 7 is a perspective view of a printer which can include an embodiment of the present teachings.

Once manufacture of the printhead is completed, one or more printheads according to the present teachings can be installed in a printer. FIG. 7 depicts a printer 700 including one or more printheads 702 and ink 704 being ejected from one or more nozzles 108 in accordance with an embodiment of the present teachings. Each printhead 702 is configured to operate in accordance with digital instructions to create a desired image on a print medium 706 such as a paper sheet, plastic, etc. Each printhead 702 may move back and forth relative to the print medium 706 in a scanning motion to generate the printed image swath by swath. Alternately, the printhead 702 may be held fixed and the print medium 706 moved relative to it, creating an image as wide as the printhead 702 in a single pass. The printhead 702 can be narrower than, or as wide as, the print medium 706. The printer hardware including the printhead 702 can be enclosed in a printer housing 708. In another embodiment, the printhead 702 can print to an intermediate surface such as a rotating drum or belt (not depicted for simplicity) for subsequent transfer to a print medium.

Embodiments of the present teachings thus provide a self-limiting method and structure for purging ink from a location within a printhead using an printhead deprime process. The deprime process is self-limiting, as the application of a single selected pressure is sufficient to move the ink meniscus from a first location, for example a nozzle, to a second location, for example a rock screen. This clears a majority of ink, or all of the ink, from a second ink port chamber located between the nozzle and the rock screen, while ink remains within a first ink port chamber upstream of the rock screen. Once the meniscus is moved to the second location, such as the rock screen, the pressure can be removed and the meniscus stays at the second location, for example because of capillary action imparted by one or more openings of the rock screen, which is/are smaller than one or more openings such as nozzles at the first location. After performing the deprime process, the printhead can be primed in accordance with known techniques in preparation for printing. The method does not sacrifice ink during the process as is found in some conventional purging processes, as the ink is moved further up the ink port and is used during subsequent printing. Further, the method can remove or prevent bubbles within the ink. If, for example, the printhead freezes after performing the deprime process, outgassing of moisture from a printhead material such as a polymer will outgas into a generally empty chamber, then move out of the chamber during a priming process. Outgassing at a location upstream from the rock screen is less of a concern, as bubbles will not typically move past the rock screen and are less likely to absorb a pressure pulse output by the piezoelectric transducer (actuator).

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. For example, it will be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It will be appreciated that structural components and/or processing stages can be added or existing structural components and/or processing stages can be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the workpiece, regardless of the orientation of the workpiece.

The invention claimed is:

1. A method for depriming a printhead, comprising:

providing a printhead, the printhead comprising:

an aperture plate comprising at least one nozzle therein; and an ink port comprising an ink port first chamber and an ink port second chamber, wherein the ink port first chamber is separated from the ink port second chamber by a particulate filter, and wherein the ink port first chamber is upstream of the particulate filter and wherein the inkport second chamber is downstream of the particulate filter;

filling the ink port first chamber and the ink port second chamber with ink;

determining a first maximum pressure differential that is sustainable across a meniscus of the ink at the at least one nozzle;

determining a second maximum pressure differential that is sustainable across a meniscus of the ink at the particulate filter;

selecting a deprime pressure based on a width of the at least one nozzle and a width of openings within the particulate filter, wherein the deprime pressure is sufficient to overcome a force of capillarity exerted on the ink by the at least one nozzle but is insufficient to overcome a force of capillarity exerted on the ink by the particulate filter; and applying the deprime pressure to the ink within the ink port, wherein the deprime pressure is sufficient to move a meniscus of the ink from the at least one nozzle to the particulate filter, but is insufficient to move the meniscus of the ink past the particulate filter, wherein the deprime pressure is further selected as a value between the first maximum pressure differential and the second maximum pressure differential.

2. The method of claim 1, further comprising:

determining the first maximum pressure differential using a formula:

$$P=\cos(\theta)*2\gamma/r$$

where "P" is the first maximum pressure differential, "θ" is an ink contact angle, "γ" is surface tension of the meniscus of the ink, and "r" is a radius of the at least one nozzle; and determining the second maximum pressure differential using the formula:

$$P=\cos(\theta)*2\gamma/r$$

where "P" is the second maximum pressure differential "θ" is an ink contact angle, "γ" is surface tension of the meniscus of the ink, and "r" is a radius of the openings within the particulate filter.

3. The method of claim 1, further comprising:

applying the deprime pressure to the ink using a pump, wherein the pump applies a negative pressure (vacuum) to the ink at a location which is upstream from the particulate filter relative to a flow of ink toward the nozzle; and subsequent to moving the meniscus of the ink from the nozzle to the particulate filter, removing the deprime pressure from the ink within the printhead.

4. The method of claim 1, wherein:

applying the deprime pressure to the ink comprises using a pump;

the pump applies a positive deprime pressure to the ink at a location which is downstream from the particulate filter relative to a flow of ink toward the at least one nozzle; and subsequent to moving the meniscus of the ink from the at least one nozzle to the particulate filter, the method further comprises removing the deprime pressure from the ink within the printhead.

5. The method of claim 4, further comprising:

contacting the aperture plate comprising the at least one nozzle with an airtight cap, wherein the pump comprises an output attached to the airtight cap; and while contacting the aperture plate with the airtight cap, applying the positive deprime pressure to the ink using the pump.

6. The method of claim 5, wherein the aperture plate further comprises a plurality of nozzles and the method further comprises:

while contacting the aperture plate with the airtight cap, applying the positive deprime pressure to the ink with the pump through the airtight cap and applying the positive deprime pressure through the plurality of nozzles.

7. The method of claim 1, wherein the particulate filter comprises a rock screen.

* * * * *